US005529967A

United States Patent [19]

Gillespie et al.

[11] Patent Number: 5,529,967

[45] Date of Patent: Jun. 25, 1996

[54] PROCESS FOR SWEETENING A SOUR HYDROCARBON FRACTION USING A SUPPORTED METAL CHELATE AND A SOLID BASE

[75] Inventors: Ralph D. Gillespie, Elgin; Jeffery C. Bricker, Buffalo Grove; Blaise J. Arena, Chicago; Jennifer S. Holmgren, Bloomingdale, all of Ill.

[73] Assignee: UOP, Des Plaines, Ill.

[21] Appl. No.: 373,164

[22] Filed: Jan. 17, 1995

Related U.S. Application Data

[62] Division of Ser. No. 151,632, Nov. 15, 1993, Pat. No. 5,413,701.

[51] Int. Cl.[6] ..... B01D 31/00

[52] U.S. Cl. ..... 502/163; 208/189; 208/207; 502/439

[58] Field of Search ..... 208/163

[56] References Cited

U.S. PATENT DOCUMENTS

| | | | |
|---|---|---|---|
| 2,918,426 | 12/1959 | Quiquerez et al. | 208/206 |
| 2,966,453 | 12/1960 | Gleim et al. | 208/206 |
| 2,988,500 | 6/1961 | Gleim et al. | 208/206 |
| 3,108,081 | 10/1963 | Gleim et al. | 252/428 |
| 3,252,892 | 5/1966 | Gleim et al. | 208/206 |
| 3,980,582 | 9/1976 | Anderson, Jr. et al. | 252/428 |
| 4,156,641 | 5/1979 | Frame | 208/207 |
| 4,290,913 | 9/1981 | Frame | 252/428 |
| 4,337,147 | 6/1982 | Frame | 208/206 |
| 4,824,818 | 4/1989 | Bricker et al. | 502/163 |
| 4,908,122 | 3/1990 | Frame et al. | 208/207 |
| 4,913,802 | 4/1990 | Bricker et al. | 208/207 |
| 5,232,887 | 8/1993 | Arena et al. | 502/161 |
| 5,286,696 | 2/1994 | Wu . | |
| 5,318,936 | 6/1994 | Ferm et al. | 502/161 |

*Primary Examiner*—Helane Myers

*Attorney, Agent, or Firm*—Thomas K. McBride; Eugene I. Snyder; Maryann Maas

[57] ABSTRACT

A catalytic system of physically separate and discrete solid materials and a mercaptan oxidation process for using the catalytic system have been developed. The catalytic system comprises a supported metal chelate dispersed on a non-basic solid support and a solid base. The process involves contacting a sour middle distillate hydrocarbon fraction which contains mercaptans first with the solid base and then, in the presence of an oxidizing agent and a polar compound, with the supported metal chelate. The process is unique in that both the catalyst and the base are solid materials and that the solid base is in a separate fixed bed from the supported metal chelate.

12 Claims, No Drawings

PROCESS FOR SWEETENING A SOUR HYDROCARBON FRACTION USING A SUPPORTED METAL CHELATE AND A SOLID BASE

This is a divisional of application Ser. No. 08/151,632 filed on Nov. 15, 1993 now U.S. Pat. No. 5,413,701.

BACKGROUND OF THE INVENTION

Processes for the treatment of a sour hydrocarbon fraction where the fraction is treated by contacting it with an oxidation catalyst and an alkaline agent in the presence of an oxidizing agent at reaction conditions have become well known and widely practiced in the petroleum refining industry. These processes are typically designed to effect the oxidation of offensive mercaptans contained in a sour hydrocarbon fraction to innocuous disulfides, a process commonly referred to as sweetening. The oxidizing agent is most often air. Gasoline, including natural, straight run and cracked gasolines, is the most frequently treated sour hydrocarbon fraction. Other sour hydrocarbon fractions which can be treated include the normally gaseous petroleum fractions as well as naphtha, kerosene, jet fuel, fuel oil, and the like.

A commonly used continuous process for treating sour hydrocarbon fractions entails contacting the fraction with a metal phthalocyanine catalyst dispersed in an aqueous caustic solution to yield a doctor sweet product. Doctor sweet means a mercaptan content in the product low enough to test "sweet" (as opposed to "sour") by the well-known doctor test. The sour fraction and the catalyst containing aqueous caustic solution provide a liquid-liquid system wherein mercaptans are converted to disulfides at the interface of the immiscible solutions in the presence of an oxidizing agent—usually air. Alternatively, the sour hydrocarbon fraction may be effectively treated by contacting it with a metal chelate catalyst dispersed on a high surface area adsorptive support—usually a metal phthalocyanine on an activated charcoal at oxidation conditions in the presence of a soluble alkaline agent. One such process is described in U.S. Pat. No. 2,988,500. The oxidizing agent is most often air admixed with the fraction to be treated, and the alkaline agent is most often an aqueous caustic solution charged continuously to the process or intermittently as required to maintain the catalyst in the caustic-wetted state.

The prior art shows that alkaline agents are necessary in order to catalytically oxidize mercaptans to disulfides. Thus, U.S. Pat. Nos. 3,108,081 and 4,156,641 disclose the use of alkali hydroxides, especially sodium hydroxide, for oxidizing mercaptans. Further, U.S. Pat. No. 4,913,802 discloses the use of ammonium hydroxide as the basic agent. U.S. Pat. No. 5,232,887 discloses the use of solid base materials which are used both as the support for the metal catalyst and as the alkaline agent. The activity of the metal chelate systems can be improved by the use of quaternary ammonium compound as disclosed in U.S. Pat. Nos. 4,290,913 and 4,337,147.

We have developed a catalytic system of solid materials and a process using the catalytic system which is significantly different from all the sweetening processes previously disclosed in the art. The prior art describes numerous types of oxidation catalysts used in combination with an alkaline agent. Furthermore, the prior art systems disclose the catalyst in intimate contact with the alkaline agent. In contrast, our invention involves the use of a solid base which is not required to be in intimate contact with the oxidation catalyst.

In fact, our invention provides that the oxidation catalyst and alkaline agent be physically separated into two reaction beds. Moreover, the demonstrated high conversion of mercaptans to disulfides of our invention was contrary to expectations set by the generally accepted working hypothesis of how the alkaline agent functions and by mercaptan oxidation of kerosine studies using the oxidation catalyst alone and the solid base alone.

SUMMARY OF THE INVENTION

The purpose of this invention is to provide a new catalytic system for use in a mercaptan oxidation process to sweeten a sour middle distillate hydrocarbon fraction. An embodiment comprises oxidizing the mercaptans by sequentially contacting the middle distillate hydrocarbon fraction first with a solid base and then, in the presence of an oxidizing agent and a polar compound, with a supported metal chelate. In a specific embodiment, the metal chelate is a cobalt phthalocyanine dispersed on charcoal. In another specific embodiment the solid base is a metal oxide solid solution. In a still more specific embodiment the metal oxide solid solution is a magnesium oxide and aluminum oxide solid solution. In yet another specific embodiment the catalyst is a cobalt phthalocyanine dispersed on charcoal, and the solid base is a magnesium oxide and aluminum oxide solid solution. Other objects and embodiments of this invention will become apparent in the following detailed description.

DETAILED DESCRIPTION OF THE INVENTION

This invention relates to a process for treating a sour middle distillate hydrocarbon fraction that contains mercaptans and to a catalytic system of discrete yet synergistic solid materials for use in said process. The process involves, sequentially contacting the hydrocarbon fraction first with a solid base and then, in the presence of an oxidizing agent and a polar compound, with a supported metal chelate. Said middle distillate hydrocarbon fraction is intended to include those hydrocarbon fractions boiling in the range of about 149° C. to about 371° C., such as kerosine, Jet fuel, and fuel oil. Said solid base is an alkaline earth metal oxide, a metal oxide solid solution, a layered double hydroxide, or a mixture thereof, and said catalyst is a metal chelate dispersed on a non-basic support. It is important to note that the alkaline agent is not in intimate contact with the catalyst. The catalytic system of materials is effective even though the solid base is necessarily physically discrete from the catalyst.

Thus, one necessary component of the instant invention is a metal chelate. The metal chelate employed in the practice of this invention can be any of the various metal chelates known to the art as effective in catalyzing the oxidation of mercaptans contained in a sour petroleum distillate to disulfides. The metal chelates include the metal compounds of tetrapyridinoporphyrazine as described in U.S. Pat. No. 3,980,582, e.g., cobalt tetrapyridinoporphyrazine; porphydn and metaloporphyrin catalysts as described in U.S. Pat. No. 2,966,453, e.g., cobalt tetraphenylporphyrin sulfonate; corrinoid catalysts as described in U.S. Pat. No. 3,252,892, e.g., cobalt corrin sulfonate; chelate organometallic catalysts such as described in U.S. Pat. No. 2,918,426, e.g., the condensation product of an aminophenol and a metal of Group VIII; and the metal phthalocyanines as described in U.S. Pat. No. 4,290,913, etc. As stated in U.S. Pat. No. 4,290,913, metal phthalocyanines are a preferred class of metal chelates. The metal phthalocyanines and their derivatives which can be employed to catalyze the oxidation of mercaptans generally include those described in U.S. Pat. No. 4,908,122 with the most preferred being cobalt phthalocyanine, sulfonated cobalt phthalocyanine, or vanadium phthalocyanine.

The metal chelate is dispersed on any of the various non-basic solid adsorbent support materials generally known and utilized as catalyst supports in the prior art as described in U.S. Pat. No. 4,908,122 which is incorporated by reference. Examples of such non-basic solid adsorbent supports are days, silicates, charcoal, and non-basic inorganic oxides. Charcoal and particularly activated charcoal is preferred because of its capacity for metal chelates and because of its stability under treating conditions. Generally, the metal chelate is present in a concentration from about 0.1 to about 10 weight percent of the catalyst.

Another necessary component of this invention is a solid base. The solid base can be an alkaline earth metal oxide, a metal oxide solid solution, a layered double hydroxide, or a mixture thereof, with the most preferred being the metal oxide solid solution. The alkaline earth metal oxide has the formula MO where M is a divalent metal selected from the group consisting of magnesium, barium, calcium, and strontium. The most preferred alkaline earth metal oxides are magnesium oxide and calcium oxide.

The metal oxide solid solution has the formula $M_a(II)M_b(III)O_{(a+b)}(OH)_b$ where M(II) is a divalent metal and M(III) is a trivalent metal. The M(II) metals are selected from the group consisting of magnesium, nickel, zinc, copper, iron, cobalt and mixtures thereof. The most preferred divalent metals are magnesium and nickel, and the most preferred mixture is magnesium and nickel. M(III) is selected from the group consisting of aluminum, chromium, gallium, scandium, iron, lanthanum, cerium, yttrium, boron, and mixtures thereof. The most preferred trivalent metals are aluminum and gallium. Finally, a and b are chosen such that the ratio of a/b is between 1 and about 15 with about 1.5 to about 10 being the most preferred. Two types of metal oxide solid solutions are the most preferred. The first type are those metal oxide solid solutions where M(II) is magnesium, M(III) is aluminum, and a/b is in the range of about 1.5 to about 5. The second type are those metal oxide solid solutions where M(II) is a combination of magnesium and nickel in all molar ratios, with the magnesium to nickel molar ratio range of about 1:1 to about 1:9 being especially preferred, M(III) is aluminum, and a/b is in the range of about 1.5 to about 10.

The metal oxide solid solutions are prepared by heating the corresponding layered double hydroxide materials (LDH) (see below) at a temperature of about 300° C. to about 750° C. When preparing the solid solution from the LDH precursor, the precursor must have as its counterion (anion) one which decomposes upon heating, e.g., nitrate or carbonate. Counterions such as chloride or bromide would be left on the solid solution support and may be detrimental to catalyst activity.

Layered double hydroxides (LDH) are basic materials that have the formula $M_a(II)M_b(III)(OH)_{(2a+2b)}(X^{-n})_{(b/n)}.cH_2O$. The M(II) and M(III) metals are the same as those described for the solid solution. The values of a and b are also as set forth above. $X^-$ is an anion selected from the group consisting of carbonate, nitrate, halides and mixtures thereof with carbonate and nitrate preferred, and n is 1 for the halides and 2 for carbonate and nitrate. Finally, $cH_2O$ is the water of hydration and is not of consequence to the instant invention's function. C usually varies from about 1 to about 100. These materials are referred to as layered double hydroxides because they are composed of octahedral layers, i.e. the metal cations are octahedrally surrounded by hydroxyl groups. These octahedra share edges to form infinite sheets. Interstitial anions such as carbonate are present to balance the positive charge in the octahedral layers. The preparation of layered double hydroxides is well known in the art and can be exemplified by the preparation of a magnesium/aluminum layered double hydroxide which is known as hydrotalcite. The formula of hydrotalcite is $Mg_6Al_2(OH)_{16}(CO_3).4H_2O$, and it can be prepared by coprecipitation of magnesium and aluminum carbonates at a high pH. Thus magnesium nitrate and aluminum nitrate (in the desired ratios) are added to an aqueous solution containing sodium hydroxide and sodium carbonate. The resultant slurry is heated at about 65° C. to crystallize the hydrotalcite and then the product is isolated and dried. Extensive details for the preparation of various LDH materials may be found in *J. Catalysis.* 94, 547–557 (1985) which is incorporated by reference.

The catalytic effectiveness of the combination in the present invention of two discrete beds to effect mercaptan oxidation was completely unexpected and is without theoretical or experimental precedent. Use of a metal chelate catalyst dispersed on a non-basic solid support alone led to mercaptan oxidation of a kerosine in only low yield. Use of a solid base material alone led to mercaptan oxidation of a kerosine in a somewhat higher yield which was still low. However, combination of a solid base followed by a metal chelate dispersed on a non-basic support afforded mercaptan oxidation in a yield far greater than that expected from the sum of the yields of the two components demonstrating that our system is truly synergistic.

EXAMPLE 1

A reactor bed was loaded with 7.5 cc of sulfonated cobalt phthalocyanine supported on high surface area carbon. A sour kerosine feedstock boiling in the range of 172° C. to 281° C. and containing about 328 ppm mercaptan sulfur was processed through the reactor bed at a liquid hourly space velocity of 6 $hours^{-1}$, an inlet temperature of 38° C. and a pressure of 100 psi. The feedstock was charged under sufficient air pressure to provide 2 times the stoichiometric amount of oxygen required to oxidize the mercaptans. Water, 7,000 ppm, and quaternary ammonium hydroxide, 8.75 ppm, were added to the feedstock. The percent conversion of mercaptans to disulfides under this system is in Table 1 in the column marked Metal Chelate.

A reactor bed was loaded with 38 cc of metal oxide solid solution where the divalent metals were magnesium and nickel in a 1:3 molar ratio, the trivalent metal was aluminum, and the ratio of all divalent metals to all trivalent metals was 2:1. The same type of feedstock as used above with identical water and quaternary ammonium hydroxide content and operating conditions was passed through the bed at a liquid hourly space velocity of 1.2 $hours^{-1}$. The percent conversion of mercaptans to disulfides under this system is in Table 1 in the column marked Solid Solution.

A two-bed reactor configuration was loaded with a first bed of 40 cc of metal oxide solid solution where the divalent metals were magnesium and nickel in a 1:3 molar ratio, the trivalent metal was aluminum, and the ratio of all divalent metals to all trivalent metals was 2:1 and a second bed of 7.5 cc of sulfonated cobalt phthalocyanine supported on high surface area carbon. The reactor had an internal diameter of 2.22 cm, and the two beds were physically separated by 1 to 2 cm. A sour kerosine feedstock boiling in the 172° C. to 281° C. range and containing about 381 ppm mercaptan sulfur was processed through the two-bed reactor at a liquid hourly space velocity of 6 $hours^{-1}$ based on the supported metal chelate only, which is equivalent to a liquid hourly space velocity of 1.1 $hours^{-1}$ based on the solid solution only, an inlet temperature of 38° C. and a pressure of 100 psig. The feedstock was charged under sufficient air pressure to provide about 2 times the stoichiometric amount of oxygen required to oxidize the mercaptans. Water, 7,000 ppm, and quaternary ammonium hydroxide, 8.75 ppm, were added to the feedstock. The percent conversion of mercaptans to disulfides under this system is in Table 1 in the column marked Sequential Contacting.

TABLE 1

| Percent Conversion of Mercaptans to Disulfides | | | |
|---|---|---|---|
| Hours on Stream | Metal Chelate | Solid Solution | Sequential Contacting |
| 4 | 17 | 68 | 99 |
| 8 | 19 | 60 | 97 |
| 12 | 17 | 63 | 97 |
| Average | 18 | 63 | 97 |

As the data table demonstrates, the conversion achieved by the invention, 97%, is substantially greater than the expected sum of the components.

The catalytic effectiveness of the invention was a further surprise since our historic working hypothesis has been that the alkaline agent functions to form a mercaptide which then reacts quickly with the supported metal chelate to form disulfide. Since we have a discrete solid alkaline agent, physically separate from the supported metal chelate, we expected the mercaptide, when formed at the alkaline agent, would be unable to move to the metal chelate bed due to the lack of an available cation. According to this hypothesis, we expected our invention to provide only low conversion of mercaptan to disulfide. Our experimental results to the contrary were wholly unexpected.

Physically separating the alkaline agent and the metal chelate has additional benefits. For example, a solid base which is separate from the metal chelate may have greater basicity than a solid base which also serves as a support for the metal chelate since the metal chelate will cover basic sites on the solid base. Consequently, the separate solid base may have increased activity due to greater basicity and extended life due to its increased capacity for poisons before deactivating.

In order to improve the activity and stability of the catalyst, an onium compound can be added to the middle distillate hydrocarbon fraction at any point prior to the supported metal chelate bed, or the onium compound can be dispersed on the non-basic support along with the metal chelate. Onium compounds are ionic compounds in which the positively charged (cationic) atom is a nonmetallic element, other than carbon, not bonded to hydrogen. For the practice of this invention it is desirable that the onium compounds have the general formula $[R'(R)_wM]^+X^-$. In said formula, R is a hydrocarbon group containing up to about 20 carbon atoms and selected from the group consisting of alkyl, cycloalkyl, aryl, alkaryl and aralkyl. It is preferred that one R group be an alkyl group containing from about 10 to about 18 carbon atoms. The other R group(s) is (are) preferably methyl, ethyl, propyl, butyl, benzyl, phenyl, and naphthyl groups. R' is a straight chain alkyl group containing from about 5 to about 20 carbon atoms and preferably an alkyl radical containing about 10 to 18 carbon atoms. M is phosphorus (phosphonium compound), nitrogen (ammonium compound), arsenic (arsonium compound), antimony (stibonium compound), oxygen (oxonium compound) or sulfur (sulfonium compound). $X^-$ is hydroxide, sulfate, nitrate, nitrite, phosphate, acetate, citrate and tartrate, w is 2 when M is oxygen or sulfur and w is 3 when M is phosphorous, nitrogen, arsenic or antimony. The preferred cationic elements are phosphorus, nitrogen, sulfur, and oxygen. The onium compounds which can be used in this invention are discussed in U.S. Pat. Nos. 4,913,802 and 4,156,641 which are incorporated by reference.

When the optional onium compound is added as a liquid to the middle distillate hydrocarbon fraction, it is desirable that it be present in a concentration from about 0.05 to about 500 ppm and preferably from about 0.5 ppm to about 100 ppm based on hydrocarbon. When the onium compound is dispersed onto the non-basic support as described in U.S. Pat. No. 4,824,818, it is desirable that the onium compound be present in a concentration from about 0.1 to about 10 weight percent of the supported metal chelate. Furthermore, the onium compound may be initially dispersed onto the non-basic support and then desired amounts within the range 0.05 to 500 ppm may be added intermittently to the middle distillate hydrocarbon fraction.

Another necessary component of the process of this invention is a polar compound, which may be added to the middle distillate hydrocarbon fraction at any point prior to the supported metal chelate bed. Generally the polar compound is present in a concentration from about 10 ppm to about 15,000 ppm based on hydrocarbon. It is believed that the function of this polar compound is to serve as a proton transfer medium. Specifically, the compound is selected from the group consisting of water, alcohols, esters, ketones, diols and mixtures thereof. Specific examples include methanol, ethanol, propanol, isopropyl alcohol, t-butyl alcohol, n-butyl alcohol, benzyl alcohol and s-butyl alcohol. Examples of diols which can be used include ethylene glycol, 1,3-propylene glycol, 1,2-propylene glycol, 1,4-butylene glycol, 1,3-butylene glycol and 2,3-butylene glycol. Examples of ketones and esters are acetone, methyl formate and ethyl acetate. Of these compounds the preferred are water and alcohols, with methanol being an especially preferred alcohol.

As previously stated, sweetening of the sour middle distillate hydrocarbon fraction is effected by oxidizing the mercaptans to disulfides. Accordingly, the process requires an oxidizing agent, preferably air, although oxygen or other oxygen-containing gases may be employed. The sour middle distillate hydrocarbon fraction may contain sufficient entrained air, but generally added air is admixed with the fraction and charged to the treating zone concurrently therewith. In some cases, it may be advantageous to charge the air separately to the treating zone and countercurrent to the fraction separately charged thereto.

The treating conditions and specific methods used to carry out the present invention are those that have been disclosed in the prior art, except for our use of two physically separate beds. The solid base is the first fixed bed contacted by the middle distillate hydrocarbon fraction, and the supported metal chelate is the second fixed bed. This configuration allows for contacting in a continuous manner. The process is usually effected at ambient temperature conditions, although higher temperatures up to about 105° C. are suitably employed. Pressures of up to about 1,000 psi or more are operable although atmospheric or substantially atmospheric pressures are suitable. Generally, contact times equivalent to an overall liquid hourly space velocity of from about 0.5 to about 40 $hours^{-1}$ or more are effective to achieve a desired reduction in the mercaptan content of a sour middle distillate hydrocarbon fraction, an optimum contact time being dependent on the size of the treating zone, the quantity of catalyst and solid base contained therein, and the character of the fraction being treated.

The system of two fixed beds may have an economic advantage in that each component may be replaced as necessary, and it is not required to replace both when only one component deactivates. Also, greater operating flexibility is achieved since each fixed bed may operated at different conditions. Regeneration of materials may be easier to perform since the regeneration conditions may be tailored to the individual component. For example, the solid base generally needs a higher temperature to regenerate then can be readily withstood by the metal chelate. Finally, the solid base may function to remove the naphthenic acids from the middle distillate hydrocarbon fraction, thereby extending the life of the metal chelate and providing a potential method of naphthenic acid recovery.

The following example is presented in illustration of this invention and is not intended as an undue limitation on the generally broad scope of the invention as set out in the appended claims.

EXAMPLE 2

A two-bed reactor configuration was loaded with 40 cc of metal oxide solid solution where the divalent metals were magnesium and nickel in a 1:3 molar ratio, the trivalent metal was aluminum, and the ratio of all divalent metals to all trivalent metals was 2:1 in the first bed the feedstock will contact, and 7.5 cc of sulfonated cobalt phthalocyanine dispersed on high surface area carbon in the second bed. A sour kerosine feedstock boiling in the 172° C. to 281° C. range and containing about 381 ppm mercaptan sulfur was processed through the two bed system at a liquid hourly space velocity of 6 $hours^{-1}$ (based on the supported metal chelate only), an inlet temperature of 38° C. and a pressure of 100 psi. The feedstock was charged under sufficient air pressure to provide about two times the stoichiometric amount of oxygen required to oxidize the mercaptans. Water, 7,000 ppm, and quaternary ammonium hydroxide, 8.75 ppm, were added to the feedstock.

The above system (System A) showed conversion of mercaptans to disulfides comparable to a 15 cc loading of a cobalt phthalocyanine catalyst dispersed on a metal oxide solid solution where the divalent metals were magnesium and nickel in a 1:3 molar ratio, the trivalent metal was aluminum, and the ratio of all divalent metals to all trivalent metals was 2:1 (System B), at the same conditions except a liquid hourly space velocity of 3 $hours^{-1}$. See Table 2.

TABLE 2

| Percent Conversion of Mercaptans to Disulfides | | |
|---|---|---|
| Hours on Stream | System A | System B |
| 4 | 99 | 93 |
| 8 | 97 | 98 |
| 12 | 97 | 98 |

Again, as the data shows, when the solid base is physically separated from the supported metal chelate the catalytic system is still effective to sweeten a sour middle distillate hydrocarbon fraction.

We claim as our invention:

1. A multi-zone catalytic system of solid materials for oxidizing mercaptans comprising in a first zone, a metal chelate dispersed on a non-basic solid support, and in a second zone, a solid base selected from the group consisting of a) alkaline earth metal oxides, b) metal oxide solid solutions having the formula $M_a(II)M_b(III)O_{(a+b)}(OH)_b$ where M(II) is a divalent metal selected from the group consisting of magnesium, nickel, zinc, copper, iron, cobalt, calcium, and mixtures thereof, M(III) is a trivalent metal selected from the group consisting of aluminum, chromium, gallium, scandium, iron, lanthanum, cerium, yttrium, boron, and mixtures thereof and a/b is between 1 to about 15, and c) layered double hydroxides represented by the formula $M_a(II)M_b(III)(OH)_{(2a+2b)}(X^{-n})_{b/n}.cH_2O$ where $X^-$ is an anion selected from the group consisting of carbonate, nitrate, halide, and mixtures thereof, n is 1 where $X^-$ is a univalent anion and 2 where $X^-$ is a divalent anion, and $cH_2O$ is water of hydration.

2. The catalytic system of claim 1 where the non-basic solid support is selected from the group consisting of charcoal, clays, silicates, and non-basic inorganic oxides.

3. The catalytic system of claim 1 where the non-basic solid support is charcoal.

4. The catalytic system of claim 1 where the metal chelate is a metal phthalocyanine.

5. The catalytic system of claim 4 where the metal phthalocyanine is cobalt phthalocyanine.

6. The catalytic system of claim 1 where the metal chelate is present in a concentration from about 0.1 to about 10 weight percent of the metal chelate dispersed on the non-basic solid support.

7. The catalytic system of claim 1 where the solid base is a metal oxide solid solution.

8. The catalytic system of claim 1 where M(II) is magnesium, M(III) is aluminum, and a/b is in the range of about 1.5 to about 5.

9. The catalytic system of claim 1 where M(II) is a combination of magnesium and nickel in all molar ratios, M(III) is aluminum, and a/b is in the range of about 1.5 to about 10.

10. The catalytic system of claim 1, where M(II) is a combination of magnesium and nickel and where the magnesium to nickel molar ratio is in the range of about 1:1 to about 1:9, M(III) is aluminum, and a/b is in the range of about 1.5 to about 10.

11. The catalytic system of claim 1 where the solid base is an alkaline earth metal oxide.

12. The catalytic system of claim 11 where the alkaline earth metal oxide is magnesium oxide.

* * * * *